US006446266B1

(12) United States Patent
Park

(10) Patent No.: US 6,446,266 B1
(45) Date of Patent: Sep. 10, 2002

(54) ADVERTISING ADJUSTMENT STRAP FOR A CAP

(75) Inventor: Boo Yl Park, Seoul (KR)

(73) Assignee: Dada Corp., Seoul (KR)

( * ) Notice: Subject to any disclaimer, the term of this patent is extended or adjusted under 35 U.S.C. 154(b) by 0 days.

(21) Appl. No.: 09/931,409

(22) Filed: Aug. 17, 2001

(51) Int. Cl.[7] ..... A42B 1/00
(52) U.S. Cl. ..... 2/195.1; 2/175.1; 2/181
(58) Field of Search ..... 2/181, 181.4, 183, 2/175.1, 195.1, 195.2, 195.3, 195.4, 195.5, 417, 418, 420; 24/442, 445

(56) References Cited

U.S. PATENT DOCUMENTS

| | | | | | |
|---|---|---|---|---|---|
| 4,499,741 | A | | 2/1985 | Harris | |
| 4,611,355 | A | | 9/1986 | Galanto et al. | |
| 4,714,096 | A | * | 12/1987 | Guay | 139/391 |
| 4,776,043 | A | | 10/1988 | Coleman | |
| 4,905,879 | A | | 3/1990 | Piccone | |
| 5,003,640 | A | | 4/1991 | Pizzacar | |
| 5,315,714 | A | * | 5/1994 | Peters et al. | 2/181.4 |
| 5,402,538 | A | * | 4/1995 | Conrad | 2/183 |
| 5,428,844 | A | * | 7/1995 | Dougherty | 2/181 |
| 5,584,076 | A | * | 12/1996 | Armstrong | 2/181.4 |
| B15,003,640 | A | | 1/1997 | Pizzacar | |
| 5,933,870 | A | | 8/1999 | Egan, Jr. et al. | |
| 6,052,831 | A | * | 4/2000 | Park | 2/175.1 |
| 6,131,202 | A | * | 10/2000 | Yan | 2/181 |
| 6,170,086 | B1 | * | 1/2001 | Lee | 2/183 |
| 6,336,224 | B1 | * | 1/2002 | Wang | 2/195.3 |

* cited by examiner

*Primary Examiner*—Danny Worrell
*Assistant Examiner*—Gary L. Welch
(74) *Attorney, Agent, or Firm*—Jacobson Holman, PLLC

(57) ABSTRACT

An advertising size adjustment strap for a baseball-style cap having a crown body, a visor and a sweat absorbent band attached to the inside periphery of the crown. The size adjustment strap, which is attached to the back portion of the lower periphery of the crown, is formed of a stretchable fabric material or band, a non-stretchable fabric material and a cylinder-shaped fabric material forming a sleeve. The non-stretchable fabric material may be used to display an advertising or decorative portion such as a logo, symbol, emblem, etc. When the wearer puts the cap on, the stretchable fabric material or band expands naturally to fit the wearer, allowing the fabric sleeves to separate and thereby displaying the advertising or decorative portion.

14 Claims, 2 Drawing Sheets

Section A-A

ADVERTISING ADJUSTMENT STRAP FOR A CAP

BACKGROUND OF THE INVENTION

1. Field of the Invention

The present invention is related to the field of size adjustment devices and, more particularly, to a decorative strap device for adjusting the size of a cap.

2. Description of the Related Art

Baseball style caps are generally comprised of a crown main body formed by a plurality of panels, a visor portion that is secured to a forward edge of the crown and extends outwardly therefrom, and a sweat absorbent band attached to the inside of the lower periphery of the crown. A size adjustment device may be attached to a back portion of the lower periphery of the crown to adjust the cap to fit a variety of head sizes. The size adjustment device is generally attached by stitching to both ends of the sweat band at the lower periphery of the crown.

For display purposes, one or more desired logos, symbols, emblems, etc., representing a person or organization may be affixed, using various methods, on the front portion of the crown. Such logos, symbols, emblems, etc., have also been attached to the cap in other places such as the side portion, visor portion, or size adjustment strap.

Size adjustment devices are generally manufactured by employing separate molds developed specifically to shape materials such as plastic, metal, iron, etc. Hook and loop closures such as Velcro® have also been used. Such devices can be inconvenient as they require each wearer to manually adjust the cap size to his or her particular head size prior to use.

SUMMARY OF THE INVENTION

In view of the foregoing, one object of the present invention is to provide an improved cap structure that includes a size adjustment device that does not require manual adjustment.

Another object of the present invention is a size adjustment device that expands naturally according to the head size of the wearer.

A further object of the invention is a size adjustment device that permits display of logos or other symbols.

A still further object of the invention is a size adjustment device formed by a non-stretchable fabric and a stretchable fabric, the non-stretchable fabric allowing display of an advertising or decorative portion, and the stretchable fabric allowing natural and automatic size adjustment.

In accordance with these and other objects, the present invention is directed to a cap having a size adjustment device attached to a lower back portion of the crown. The size adjustment device is formed by a stretchable fabric material or band, a non-stretchable fabric material and a cylinder-shaped fabric material, combined so as to permit the non-stretchable fabric material to display an advertising or decorative portion such as logos, symbols, emblems, etc., of a company, person or organization. When the cap is not being worn, the non-stretchable fabric material is enclosed within and covered by the cylinder-shaped fabric material. When a wearer puts the cap on, the stretchable fabric material or band expands naturally according to the head size of the wearer to allow the cylinder-shaped fabric material to open, thereby exposing the logos, symbols, etc. presented on the non-stretchable fabric material.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
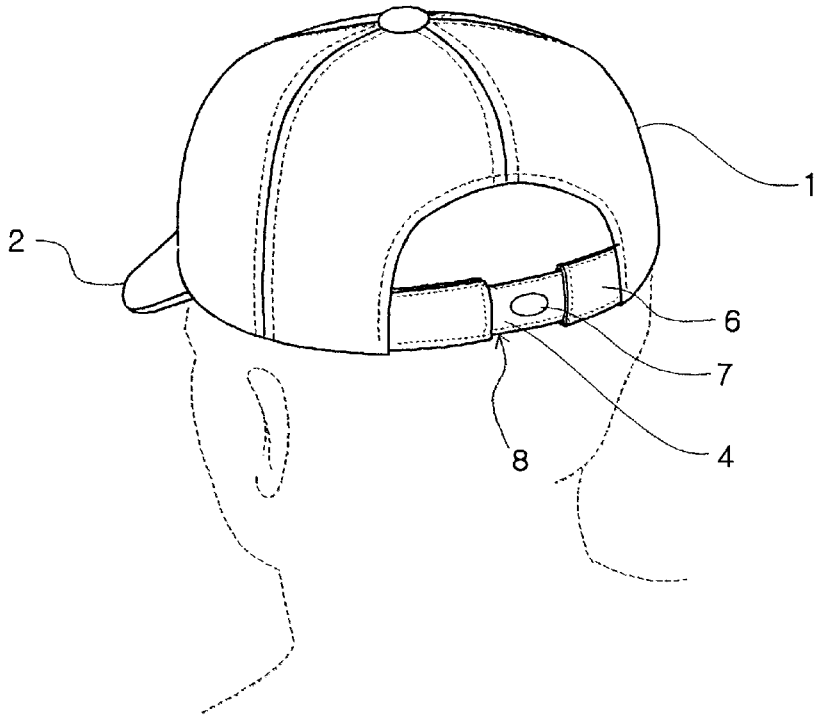
FIG. 1 is a perspective view of the advertising size adjustment strap for a cap shown in use, in accordance with the present invention.

In describing a preferred embodiment of the invention illustrated in the drawings, although only one preferred embodiment of the invention is explained in detail, it is to be understood that the embodiment is given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

In accordance with a preferred embodiment of the present invention, the present invention is directed to an advertising strap cap which expands naturally when worn. With particular attention directed to FIGS. 1 and 2, the present invention provides an improved cap structure comprising a crown main body 1 formed of a plurality of fabric segments or panels, and a visor portion 2 secured to a forward edge of the crown and extending outwardly therefrom. The fabric segments may be made of a normal woven fabric or of a stretchable fabric material. The cap also includes a sweat absorbent band 3 attached to the inside of the lower periphery of the crown, as shown in FIG. 3.

Figure 3:
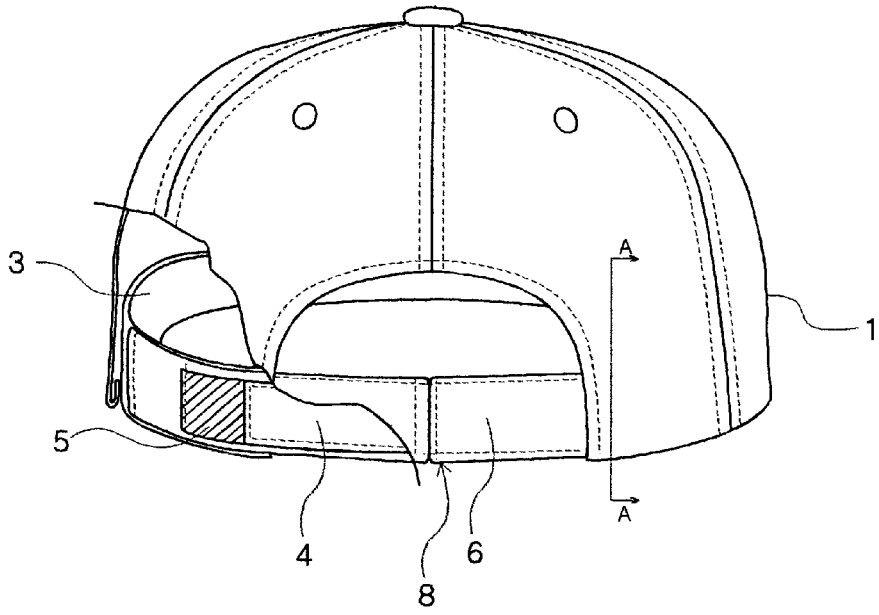
FIG. 3 is a partial cross-sectional view of the advertising size adjustment strap of FIG. 2.
Figure 3A:
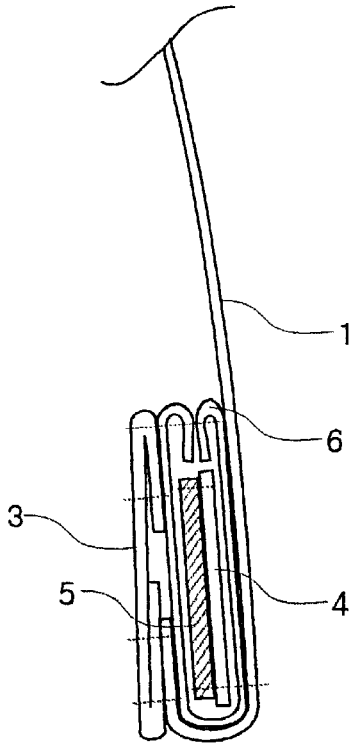
FIG. 3A is an enlarged partial cross-sectional view taken along the line A-A of FIG. 3.

A size adjustment device, generally designated by the reference numeral 8, is attached to a back portion of the lower periphery of the crown 1 to adjust the cap to fit a variety of head sizes. The size adjustment device is formed by attaching a non-stretchable fabric material 4 on top of a stretchable fabric material or band 5, as shown in FIGS. 3 and 3A. The non-stretchable fabric material is used to present an advertising or decorative portion 7 for display, generating viewer interest and increasing the effect of advertising. The advertising or decorative portion 7 may be any logo, symbol, letter, number, emblem, etc.

Two pieces of cylinder-shaped fabric material form respective fabric sleeves 6 which enclose the non-stretchable fabric material 4. These sleeves are used to cover the non-stretchable fabric material 4 of the size adjustment device 8 when the cap is not in use. The stretchable fabric material or band 5 and the fabric sleeves 6 are respectively attached to each end of the sweat absorbent band 3 at the back portion of the 10 crown.

As shown in FIG. 1, when a wearer puts the cap on, the stretchable fabric material 5 expands naturally to accommodate the head size of the wearer. This expansion pulls the two fabric sleeves 6 apart from one another, as each sleeve 6 is attached to a respective end of the sweat absorbent band 3. As the sleeves are drawn apart, the non-stretchable fabric material 4 which passes through the sleeves is revealed (to the extent that the sleeves are separated from one another), displaying any advertising or decorative portion presented thereon.

Figure 2:
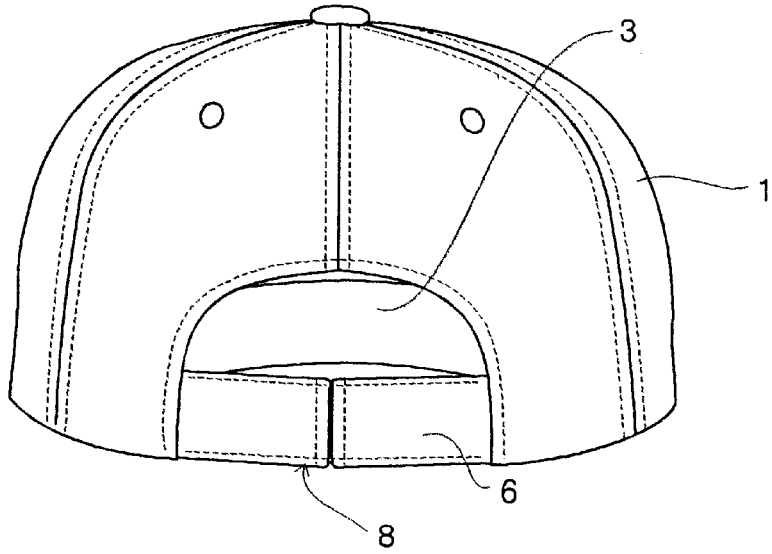
FIG. 2 is a rear view of the advertising size adjustment strap of FIG. 1, showing the cap when not in use.

When the cap is not being worn, as shown in FIG. 2, the stretchable fabric material 5 returns to a non-extended condition, pulling the sleeves together such that the sleeves 6 cover the advertising or decorative portion 7 presented on the non-stretchable fabric material 4.

FIG. 3 is a partial cross-sectional view of the advertising adjustment strap cap according to the present invention. The size adjustment device 8 is attached to the ends of the sweatband 3 adjacent the back portion of the cap. Such attachment may be effected by sewing together the stretchable fabric material or band 5, the fabric sleeves 6, the sweatband 3, and the lower periphery of the crown so that the stretchable fabric material or band 5 expands naturally at the back ends of the sweatband 3, without the obstruction of the non-stretchable fabric material 4, so as to allow the sleeves 6 to "opened" or separated from one another. It is also possible to sew the non-stretchable fabric material 4, the stretchable fabric material or band 5, the fabric sleeves 6, the sweatband 3, and the lower periphery of the crown together at only one end of the sweatband so as to fix one end and allow only the other end to expand.

FIG. 3A is an enlarged partial cross-sectional view taken on line A-A of FIG. 3. As illustrated, the adjustment strap device is formed by attaching the non-stretchable fabric material 4 to the stretchable fabric material or band 5, and covering the attached materials with a fabric material sleeve 6 which maintains a cylinder shape. The sleeve 6, crown portion 1 and sweatband 3 are then sewn together.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the size adjustment device may be incorporated into other clothing items such as cuffs on jackets or turtlenecks. Therefore, it is not desired to limit the invention to the specific examples disclosed or the exact construction and operation shown and described. Rather, all suitable modifications and equivalents may be resorted to, falling within the scope of the invention.

What is claimed is:

1. A baseball-style cap comprising:

a crown portion with a lower peripheral edge;

a sweatband attached to said lower peripheral edge; and a size adjustment device attached to said lower peripheral edge of said crown at a back portion, said size adjustment device including a stretchable fabric material, a non-stretchable fabric material attached and on top of the stretchable fabric material two fabric sleeves, said non-stretchable material passing through said two fabric sleeves.

2. The baseball-style cap as set forth in claim 1, wherein said crown portion is formed of a non-stretchable fabric material.

3. The baseball-style cap as set forth in claim 1, wherein said crown portion is formed of a stretchable fabric material.

4. The baseball-style cap as set forth in claim 1, wherein said stretchable material is a stretchable fabric.

5. The baseball-style cap as set forth in claim 1, wherein said stretchable material is an elastic band.

6. The baseball-style cap as set forth in claim 1, wherein said non-stretchable fabric material is attached on top of the stretchable material.

7. The baseball-style cap as set forth in claim 1, wherein said two sleeves are respectively attached to each end of said sweatband.

8. The baseball-style cap as set forth in claim 1, wherein said two sleeves are respectively attached to said stretchable material, each end of said sweatband, and the lower periphery of the back portion of said crown portion.

9. The baseball-style cap as set forth in claim 1, wherein one of said two sleeves is attached to one end of said sweatband along with the stretchable material, the non-stretchable material and the lower periphery of the back portion of said crown portion, said other sleeve being attached to the other end of said sweatband along with the stretchable material and the lower periphery of the back portion of said crown portion.

10. The baseball-style cap as set forth in claim 1, wherein said non-stretchable fabric material includes an advertising portion.

11. The baseball-style cap as set forth in claim 1, wherein said non-stretchable fabric material includes a decorative portion.

12. A baseball cap comprising:

a crown portion with a lower peripheral edge;

a sweatband attached to said lower peripheral edge; and a size adjustment device attached to said lower peripheral edge of said crown at a back portion, said size adjustment device including a stretchable fabric material, a non-stretchable fabric material attached and on top of the stretchable fabric material two fabric sleeves, said non-stretchable fabric material being covered by said two fabric sleeves when said cap is not in use and, when said cap is worn, extension of said stretchable material separating said fabric sleeves from one another to uncover said non-stretchable fabric material.

13. The baseball-style cap as set forth in claim 1, wherein said non-stretchable fabric material includes an advertising portion which is exposed when said non-stretchable material is uncovered.

14. The baseball-style cap as set forth in claim 1, wherein said non-stretchable fabric material includes a decorative portion which is exposed when said non-stretchable material is uncovered.

* * * * *